US009928709B2

(12) United States Patent
Takasu et al.

(10) Patent No.: US 9,928,709 B2
(45) Date of Patent: Mar. 27, 2018

(54) FIRE DETECTION DEVICE AND METHOD OF DETECTING FIRE

(71) Applicant: FUJITSU LIMITED, Kawasaki-shi, Kanagawa (JP)

(72) Inventors: Ryozo Takasu, Isehara (JP); Jiyunichi Iwata, Sagamihara (JP)

(73) Assignee: FUJITSU LIMITED, Kawasaki (JP)

( * ) Notice: Subject to any disclaimer, the term of this patent is extended or adjusted under 35 U.S.C. 154(b) by 47 days.

(21) Appl. No.: 15/164,937

(22) Filed: May 26, 2016

(65) Prior Publication Data

US 2016/0358442 A1 Dec. 8, 2016

(30) Foreign Application Priority Data

Jun. 5, 2015 (JP) ..... 2015-114819

(51) Int. Cl.

| | |
|---|---|
| ***G08B 17/12*** | (2006.01) |
| ***G08B 17/117*** | (2006.01) |
| ***G08B 25/10*** | (2006.01) |
| ***G08B 25/14*** | (2006.01) |

(52) U.S. Cl.

CPC ..... *G08B 17/117* (2013.01); *G08B 25/10* (2013.01); *G08B 25/14* (2013.01)

(58) Field of Classification Search

CPC ..... G08B 17/117; G08B 25/10; G08B 25/14
USPC ..... 340/577
See application file for complete search history.

(56) References Cited

U.S. PATENT DOCUMENTS 3,763,428 A * 10/1973 Preist ..... G01N 15/0266 324/71.1
3,901,602 A * 8/1975 Gravatt, Jr. ..... G01N 21/21 250/574
4,017,792 A * 4/1977 Heiland ..... G01N 33/4972 324/71.1
4,308,531 A * 12/1981 Yamamoto ..... G08B 29/04 250/573

(Continued)

FOREIGN PATENT DOCUMENTS

JP S62-263442 11/1987
JP H07-254096 10/1995

(Continued)

*Primary Examiner* — Zhen Y Wu
(74) *Attorney, Agent, or Firm* — Kratz, Quintos & Hanson, LLP

(57) ABSTRACT

A fire detection device includes a gas sensor, a measuring instrument, and a control device. The gas sensor is configured to detect a gaseous substance in a measurement space. The gas sensor is configured to output a first result of the detection. The measuring instrument is configured to measure a diameter of each particle existing in the measurement space and count a number of particles for each of diameter ranges to generate distribution data. The control device includes a processor. The processor is configured to determine, on basis of the first result acquired from the gas sensor, whether a smoke exists in the measurement space. The processor is configured to start the measuring instrument upon determining that a smoke exists in the measurement space. The processor is configured to determine, on basis of first distribution data acquired from the measuring instrument, whether a fire has occurred.

15 Claims, 14 Drawing Sheets

(56) References Cited

U.S. PATENT DOCUMENTS 5,168,262 A * 12/1992 Okayama ..... G08B 17/00 340/505
5,477,218 A * 12/1995 Manmoto ..... G08B 17/107 250/574
5,691,703 A 11/1997 Roby
5,691,704 A 11/1997 Wong
8,947,230 B1 * 2/2015 Gettings ..... G01N 21/84 181/139
9,547,968 B2 * 1/2017 Adams ..... G08B 17/117
2002/0073991 A1 * 6/2002 Gonda ..... A61M 15/00 128/200.22
2008/0058045 A1 * 3/2008 Cortenraad ..... A63F 3/00643 463/9
2009/0072981 A1 * 3/2009 Powell ..... G08B 17/06 340/628
2010/0039274 A1 * 2/2010 Cole ..... G01N 21/53 340/630
2011/0057282 A1 * 3/2011 Ellis-Monaghan ..... H01L 27/14607 257/443
2011/0194111 A1 * 8/2011 Dohi ..... G01N 21/53 356/340
2012/0001760 A1 * 1/2012 Harchanko ..... G08B 17/12 340/578
2012/0092175 A1 * 4/2012 Adams ..... G08B 17/117 340/627
2013/0016212 A1 * 1/2013 Laceky ..... H02J 1/10 348/143
2013/0088238 A1 * 4/2013 Julicher ..... G08B 17/11 324/469
2016/0300466 A1 * 10/2016 Williamson ..... G01N 1/26

FOREIGN PATENT DOCUMENTS

JP 2000-504132 4/2000
JP 2000-516000 11/2000

* cited by examiner

FIG.6

225A

| SENSOR NUMBER | RESISTANCE VALUE (Ω) |
|---|---|
| 1 | R1 |
| 2 | R2 |
| 3 | R3 |

FIG.8

225B

| UPDATE DATE | CA (>0.5μm) | CB (>2.5μm) | CA / CB |
|---|---|---|---|
| MM/DD hh:mm | C1 | C2 | C3 |

FIG.12

310

| IDENTIFICATION NUMBER OF FIRE DETECTION DEVICE | INSTALLATION POSITION (LATITUDE AND LONGITUDE) |
|---|---|
| 1 | (PN_1, PE_1) |
| 2 | (PN_2, PE_2) |
| 3 | (PN_3, PE_3) |
| ⋮ | ⋮ |
| M | (PN_M, PE_M) |

FIRE DETECTION DEVICE AND METHOD OF DETECTING FIRE

CROSS-REFERENCE TO RELATED APPLICATION

This application is based upon and claims the benefit of priority from the prior Japanese Patent Application No. 2015-114819 filed on Jun. 5, 2015, the entire contents of which are incorporated herein by reference.

FIELD

The embodiment discussed herein is related to a fire detection device and method of detecting a fire.

BACKGROUND

As one of systems for detecting a fire (e.g., a forest fire) at an early stage in order to minimize the damages caused by the fire, there has been known a system for detecting a hot portion (heat source) from an image generated by an infrared camera.

As other systems for detecting a forest fire, there has been known, for example, a system for detecting a smoke from a visible light image, or a system for detecting a smoke from an image captured by a camera mounted on a satellite.

As one of systems for detecting a fire using a camera, there has been known a system that captures an image of a place where a fire has occurred using a television camera, when it is determined that the fire has occurred based on data of detectors that detects, for example, a smoke concentration or temperature.

As one of fire detectors for detecting an occurrence of a fire on the basis of presence or absence of a smoke caused by the fire, there has been known a fire detector which combines a photoelectric or ionization smoke detector with a $CO_2$ sensor in order to reduce a false alarm.

In addition, as one of methods for detecting a fire at an early stage, there has been known a method in which two types of detectors each having different signs of a fire to be detected are used to determine whether or not a fire has occurred, based on the detection results of the two types of detectors.

Related techniques are disclosed in, for example, Japanese Laid-Open Patent Publication No. 07-254096, Japanese National Publication of International Patent Application No. 2000-504132, and Japanese National Publication of International Patent Application No. 2000-516000.

The temperature of an object existing within an image capturing range may be identified from an infrared camera image. However, it may not be possible to identify the reason why and how a hot portion reaches a high temperature An object existing within an image capturing range may become a high temperature due to, for example, a temperature rise by the sunshine as well as the heat from a fire. Therefore, a fire ranger has to always monitor the images of the infrared camera to check the presence of a fire occurrence.

In addition, when a smoke is detected from a visible light image, it is difficult to determine whether the smoke is caused by a fire or a temporary smoke caused by other reasons.

Further, in a case where an infrared camera or a visible light camera is used to detect a fire occurring in a wide range such as, for example, in the mountains, there is a need to install a great number of cameras throughout the wide range, which results in an increase in installation costs.

SUMMARY

According to an aspect of the present invention, provided is a fire detection device including a gas sensor, a measuring instrument, and a control device. The gas sensor is configured to detect a gaseous substance in a measurement space. The gas sensor is configured to output a first result of the detection. The measuring instrument is configured to measure a diameter of each particle existing in the measurement space. The measuring instrument is configured to count a number of particles for each of diameter ranges to generate distribution data. The control device includes a processor. The processor is configured to determine, on basis of the first result acquired from the gas sensor, whether a smoke exists in the measurement space. The processor is configured to start the measuring instrument upon determining that a smoke exists in the measurement space. The processor is configured to determine, on basis of first distribution data acquired from the measuring instrument, whether a fire has occurred.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

FIG. 6 is a diagram illustrating an exemplary setting of a first determination value;

FIG. 8 is a diagram illustrating an exemplary setting of a second determination value;

FIG. 12 is a diagram illustrating an example of registration data;

DESCRIPTION OF EMBODIMENT

Figure 1:
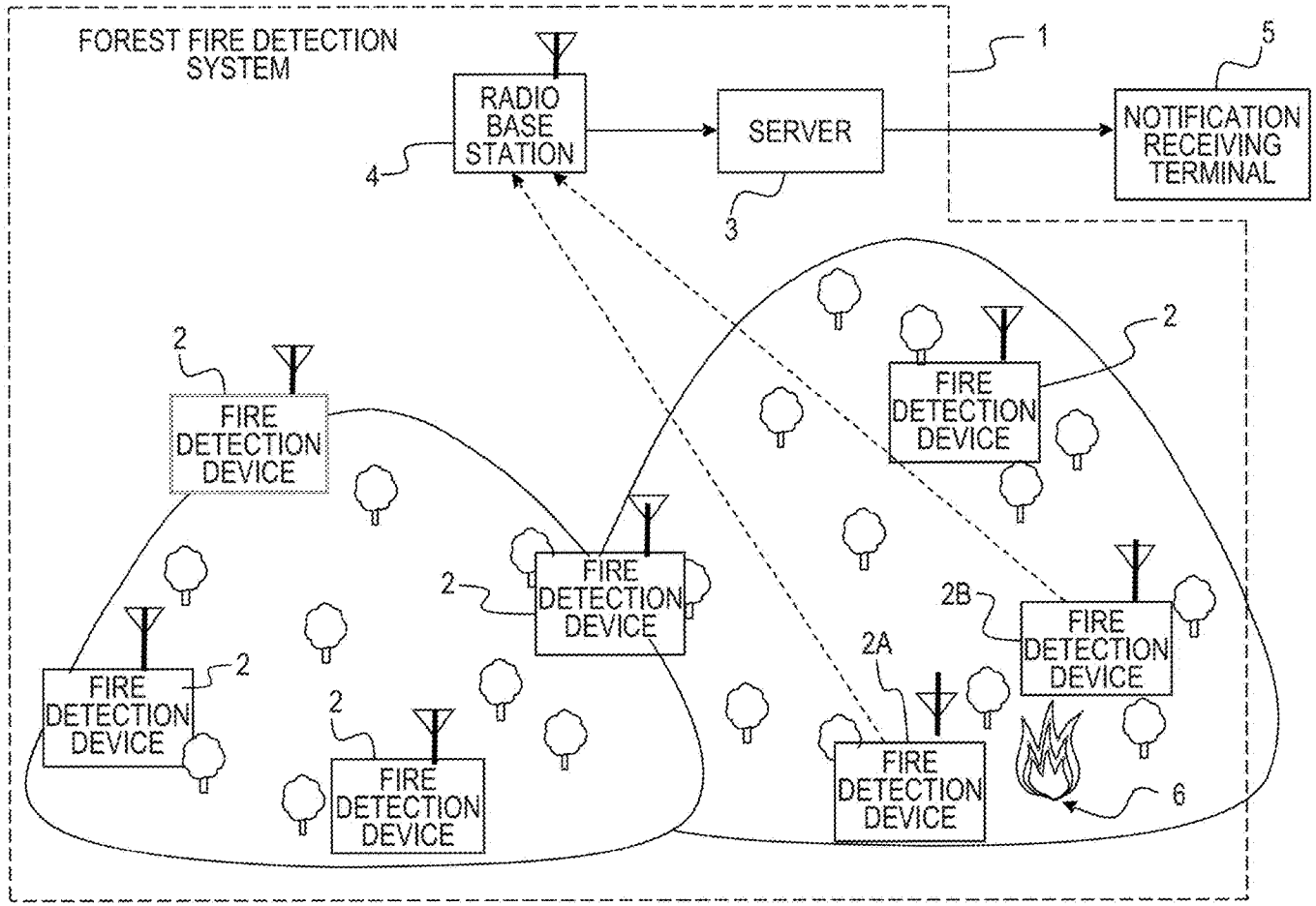
FIG. 1 is a diagram illustrating an exemplary configuration of a forest fire detection system according to an embodiment.

FIG. 1 is a diagram illustrating an exemplary configuration of a forest fire detection system according to an embodiment.

FIG. 1 illustrates a forest fire detection system for detecting a forest fire, as one example of a fire detection system. As illustrated in FIG. 1, a forest fire detection system 1 includes a plurality of fire detection devices 2, a server 3, and a radio base station 4.

Each fire detection device 2 is a device for detecting a fire (forest fire). The plurality of fire detection devices 2 are arranged at predetermined intervals in a region where a forest fire is to be detected. Upon detecting a fire, each fire detection device 2 generates a fire occurrence signal containing an identification number assigned to the fire detection device 2 and transmits the signal to the server 3.

Each fire detection device 2 is a device capable of conducting a radio communication and transmits a fire occurrence signal to the server 3 via the radio base station 4 connected to the server 3, as illustrated in FIG. 1. The server 3 and the radio base station 4 are communicably connected with each other via a wired or wireless communication.

The server 3 detects (monitors) presence or absence of a fire occurrence in cooperation with the plurality of fire detection devices 2. Upon receiving the fire occurrence signal from the fire detection device 2, the server 3 generates a notification signal to notify of the fire occurrence and transmits (notifies) the notification signal to a notification receiving terminal 5 installed in, for example, a fire station. The server 3 holds registration data associating an identification number of the fire detection device 2 with an installation position thereof and determines a fire occurrence position on the basis of the identification number of the fire detection device 2 included in the fire occurrence signal. Then, the server 3 generates the notification signal including the determined fire occurrence position and transmits the notification signal to the notification receiving terminal 5.

For example, when a fire occurs in a fire occurrence position 6 illustrated in FIG. 1, a smoke caused by the fire spreads and is detected by fire detection devices 2A and 2B installed near the fire occurrence position 6. Upon detecting the smoke, each of the fire detection devices 2A and 2B generates a fire occurrence signal and transmits the fire occurrence signal to the server 3 via the radio base station 4. Upon receiving the fire occurrence signals, the server 3 determines that a fire has occurred near the installation positions of the fire detection devices 2A and 2B, generates a notification signal, and transmits the notification signal to the notification receiving terminal 5.

Figure 2:
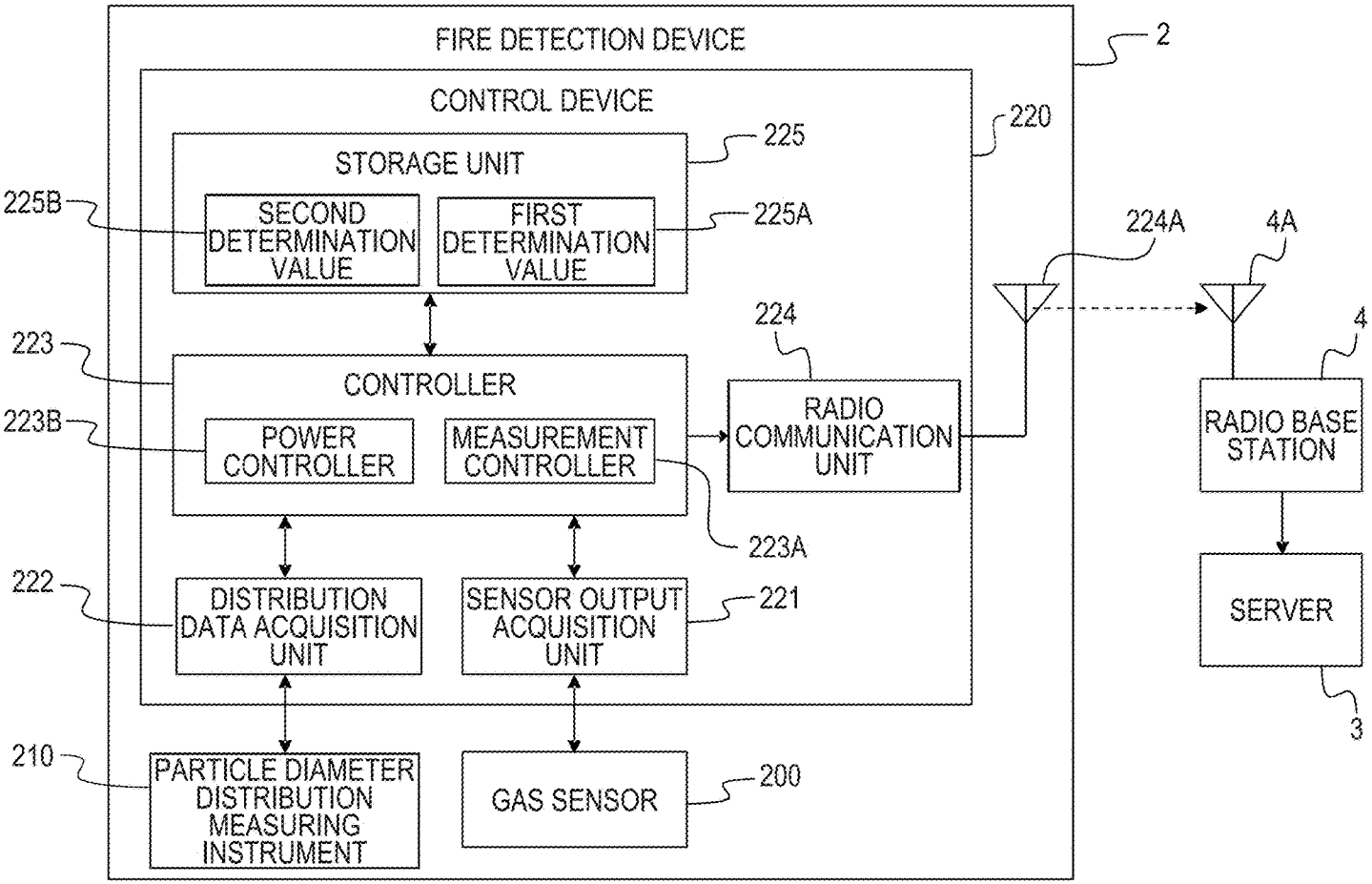
FIG. 2 is a diagram illustrating a functional configuration of a fire detection device.

FIG. 2 is a diagram illustrating a functional configuration of a fire detection device.

As illustrated in FIG. 2, the fire detection device 2 includes a gas sensor 200, a particle diameter distribution measuring instrument 210, and a control device 220.

The gas sensor 200 is a sensor that detects a gaseous chemical substance in the air (atmosphere). In the embodiment, a metal-oxide semiconductor (MOS) gas sensor is used as the gas sensor 200. The MOS gas sensor is a gas sensor that detects a gaseous chemical substance by using a change in electric resistance of a metal-oxide semiconductor by an oxidation-reduction reaction between the metal-oxide semiconductor and a chemical substance in the air.

The particle diameter distribution measuring instrument 210 is also called a particle counter which measures the diameter of a particle existing in a measurement space and counts the number of particles for each of diameter ranges.

Based on an output value of the gas sensor 200 and a result of the measurement by the particle diameter distribution measuring instrument 210, the control device 220 determines whether or not a fire has occurred. When it is determined that a fire has occurred, the control device 220 generates a fire occurrence signal and transmits the fire occurrence signal to the server 3 via the radio base station 4.

The control device 220 includes a sensor output acquisition unit 221, a distribution data acquisition unit 222, a controller 223, a radio communication unit 224, and a storage unit 225.

The sensor output acquisition unit 221 acquires an output value (output voltage) of the gas sensor 200 for each of predetermined time intervals while continuously supplying an operation power of a predetermined voltage to the gas sensor 200 (MOS gas sensor). The time interval at which the sensor output acquisition unit 221 acquires the output value of the gas sensor 200 may be, for example, one to several seconds. The sensor output acquisition unit 221 sends the acquired output value of the gas sensor 200 to the controller 223.

The distribution data acquisition unit 222 acquires distribution data which is results of the measurement of the particle diameter distribution measuring instrument 210. In addition, the distribution data acquisition unit 222 controls the start and stop of the particle diameter distribution measuring instrument 210 in accordance with a control signal from the controller 223. In other words, the distribution data acquisition unit 222 controls the supply of an operation power to the particle diameter distribution measuring instrument 210 in cooperation with the controller 223.

The controller 223 performs processes such as, for example, the determination on whether or not a smoke has occurred based on the output value of the gas sensor 200 acquired by the sensor output acquisition unit 221, control of operation of the particle diameter distribution measuring instrument 210, generation of a fire occurrence signal. As illustrated in FIG. 2, the controller 223 includes a measurement controller 223A and a power controller 223B.

The measurement controller 223A performs processes such as, for example, the determination on whether or not a smoke has occurred, determination on whether or not to cause the particle diameter distribution measuring instrument 210 to perform a measurement, determination on whether a forest fire has occurred based on a measurement result of the particle diameter distribution measuring instrument 210, and generation of a fire occurrence signal.

The power controller 223B controls power-ON/OFF of, for example, the particle diameter distribution measuring instrument 210 or the radio communication unit 224 in cooperation with the measurement controller 223A. The power controller 223B stops the particle diameter distribution measuring instrument 210 by turning OFF the power supply of the particle diameter distribution measuring instrument 210 in a time period except for the time period during which the particle diameter distribution measuring instrument 210 is caused to perform a measurement. Then, when the measurement controller 223A determines to cause the particle diameter distribution measuring instrument 210 to perform a measurement, the power controller 223B turns ON the power supply of the particle diameter distribution measuring instrument 210 through the distribution data acquisition unit 222 and causes the particle diameter distribution measuring instrument 210 to measure a particle diameter concentration, that is, measure the diameter of particles in a measurement space and count the number of particles for every diameter range.

In addition, the power controller 223B stops a radio communication function by stopping the supply of an operation power to the radio communication unit 224 in a time period except for the time period during which a fire occurrence signal is transmitted to the server. Then, when the measurement controller 223A determines that there is a need to transmit the fire occurrence signal to the server 3, the power controller 223B supplies the operation power to the radio communication unit 224 to allow the radio communication unit 224 to transmit the fire occurrence signal.

The radio communication unit 224 conducts a radio communication with the radio base station 4 installed by a provider who provides the forest fire detection system 1, in accordance with a predetermined radio communication standard. In the forest fire detection system 1 according to the embodiment, since a plurality of fire detection devices is arranged in an area of a square of several hundred meters to several kilometers, the radio communication unit 224 and the radio base station 4 use a communication module or a communication device which is capable of conducting a radio communication in a radius of several kilometer distance.

Figure 3:
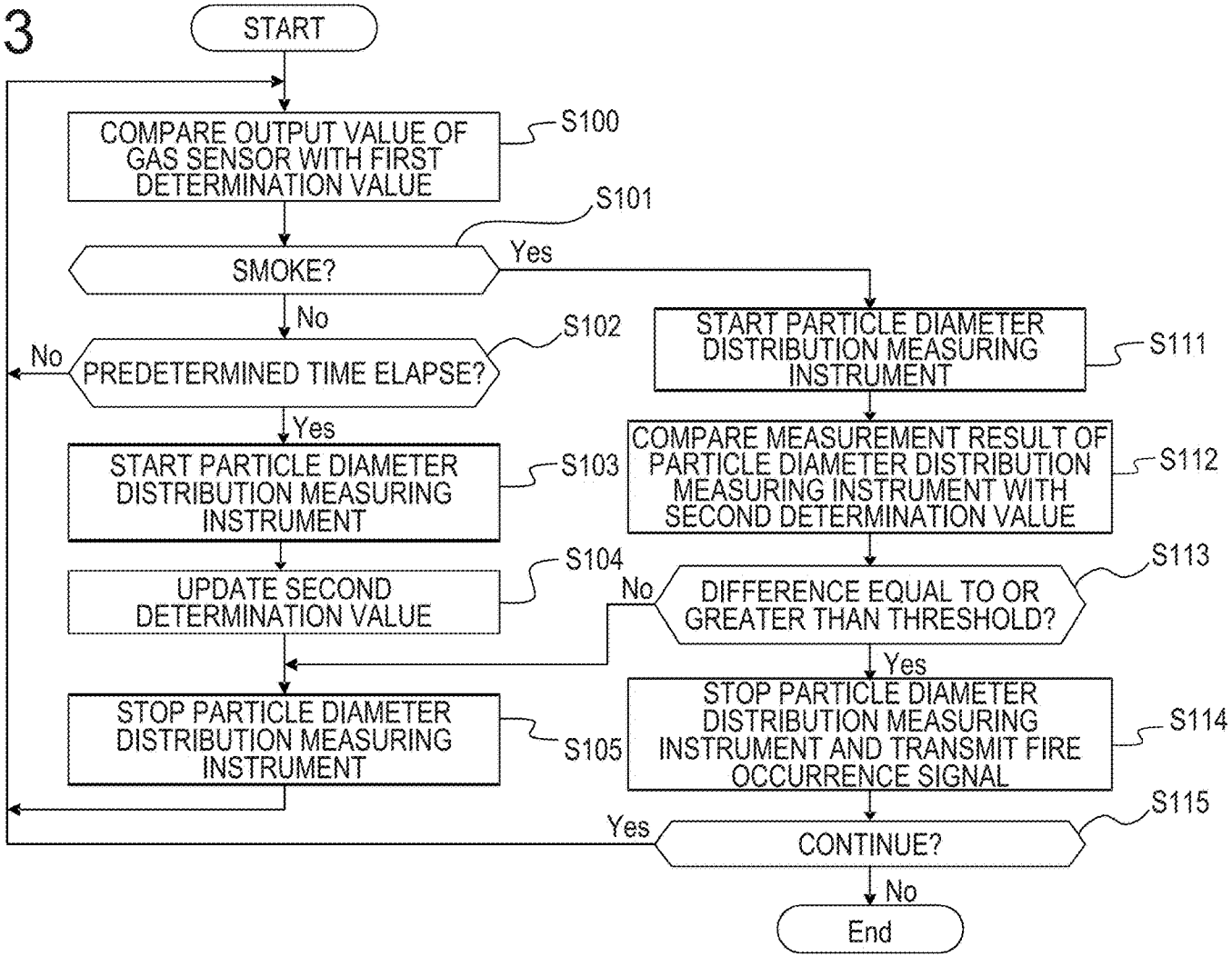
FIG. 3 is a flowchart illustrating a process performed by a control device.

FIG. 3 is a flowchart illustrating the process performed by the control device.

After being installed at a predetermined position, the fire detection device 2 continues to perform the process of detecting whether or not a fire has occurred, under the control of the control device 220. At this time, the control device 220 performs the processes illustrated in FIG. 3. A first determination value 225A and a second determination value 225B which are prepared in advance are stored in the storage unit 225 of the control device 220.

The first determination value 225A that is used for determining whether or not the measurement by the particle diameter distribution measuring instrument 210 is to be performed, is determined based on a response characteristic of the gas sensor 200 which is measured in advance by using a test gas imitating a smoke in a case where a forest fire has occurred. The second determination value 225B that is used for determining whether or not a forest fire has occurred is determined based on a measurement result of the particle diameter distribution measuring instrument 210 around the installation position of the fire detection device 2 in the normal period (when no forest fire has occurred). Information on a registration date (update date) is also marked in the second determination value 225B.

When the fire detection device 2 starts the process illustrated in FIG. 3, the power controller 223B of the control device 220 turns OFF the power supply of the particle diameter distribution measuring instrument 210. That is, the control device 220 starts the process illustrated in FIG. 3 in a state where an operation power is supplied to only the gas sensor 200 and not to the particle diameter distribution measuring instrument 210.

When the fire detection device 2 starts the process of detecting presence or absence of a forest fire occurrence, the control device 220 first acquires an output value of the gas sensor 200, compares the output value with the first determination value 225A (S100), and checks whether or not a smoke is detected (S101). S100 and S101 are performed by the measurement controller 223A in cooperation with the sensor output acquisition unit 221 and the gas sensor 200.

In a case where the above-mentioned MOS gas sensor is used as the gas sensor 200, a resistance value of a detector of the MOS gas sensor decreases when the detector is exposed to a smoke caused by a forest fire. Therefore, when a resistance value calculated based on the output value of the gas sensor 200 acquired through the sensor output acquisition unit 221 is below the first determination value 225A, the measurement controller 223A determines that a smoke has been detected.

When no smoke is detected (No in S101), the control device 220 subsequently checks whether or not a predetermined period elapses from the registration date (update date) of the second determination value 225B (S102).

When the predetermined period elapses (Yes in S102), the control device 220 performs a process of updating the second determination value 225B (S103 to S105).

In the process of updating the second determination value 225B, first, the power controller 223B starts the particle diameter distribution measuring instrument 210 by supplying an operation power to the particle diameter distribution measuring instrument 210 (S103). In S103, the power controller 223B transmits a control signal to turn ON the power supply of the particle diameter distribution measuring instrument 210 while supplying the operation power to the particle diameter distribution measuring instrument 210 through the distribution data acquisition unit 222. When the power supply of the particle diameter distribution measuring instrument is turned ON, the particle diameter distribution measuring instrument 210 performs, for example, a self-check at the start-up and then begins to measure the diameter of particles and count the number of particles for every diameter range.

Next, the measurement controller 223A acquires the measurement result of the particle diameter distribution measuring instrument 210 through the distribution data acquisition unit 222 and updates the value for determination described in the second determination value 225B to the acquired measurement result (S104). In S104, the measurement controller 223A updates the update date along with the value for determination described in the second determination value 225B.

When the update of the second determination value 225B is completed, the measurement controller 223A stops the operation of the particle diameter distribution measuring instrument 210 (S105), and the power controller 223B stops the supply of an operation power to the particle diameter distribution measuring instrument 210.

Thereafter, the control device 220 (the measurement controller 223A) returns to S100. When the predetermined period does not elapse from the registration date (update date) of the second determination value 225B (No in S102), the control device 220 skips S103 to S105 and returns to S100.

Thereafter, the control device 220 repeats S100 to S105 until it is determined in S101 that a smoke is detected.

When it is determined that a smoke is detected based on the output value of the gas sensor 200 (Yes in S101), the control device 220 subsequently starts up the particle diameter distribution measuring instrument 210 (S111). In S111, the control device 220 performs the same process as S103. Next, the measurement controller 223A acquires the measurement result of the particle diameter distribution measuring instrument 210, compares the result with the second determination value 225B (S112), and checks whether or not a difference between the acquired measurement result and the second determination value 225B is equal to or greater than a threshold (S113). In S112, the measurement controller 223A acquires the measurement result of the particle diameter distribution measuring instrument 210 through the distribution data acquisition unit 222.

As a result of the comparison in S112, when the difference between the measurement result and the second determination value 225B is smaller than the threshold (No in S113), the control device 220 stops the operation of the particle diameter distribution measuring instrument 210 (S105) and returns to S100.

As a result of the comparison in S112, when the difference between the measurement result and the second determination value 225B is equal to or greater than the threshold (Yes in S113), the control device 220 stops the operation of the particle diameter distribution measuring instrument 210 and transmits a fire occurrence signal (S114). In S114, the measurement controller 223A and the power controller 223B stop the operation of the particle diameter distribution measuring instrument 210 and stop the supply of operation power to the particle diameter distribution measuring instrument 210 in the same process as S105. In addition, in S114, after generating a fire occurrence signal, the measurement controller 223A transmits the fire occurrence signal from the radio communication unit 224 (antenna 224A). The transmitted fire occurrence signal is received by the radio base station 4 (antenna 4A). The radio base station 4 transmits the received fire occurrence signal to the server 3.

After transmitting the fire occurrence signal, the control device 220 determines whether or not to continue the detecting process (S115). When it is determined that the detecting process is to be continued (Yes in S115), the control device 220 returns to S100. When it is determined that the detecting process is not to be continued (No in S115), the control device 220 ends the detecting process and stops the operation.

In this manner, the control device 220 in the fire detection device 2 according to the embodiment performs the process of detecting whether or not a smoke has occurred by using the gas sensor 200, always or regularly at time intervals of several to several ten seconds. When an occurrence of a smoke is detected based on the output value of the gas sensor 200, the control device 220 determines whether or not a forest fire has occurred, by supplying an operation power to the particle diameter distribution measuring instrument 210 for measurement.

When a timing at which the second determination value 225B is to be updated comes in a situation where no smoke has occurred, the control device 220 supplies an operation power to the particle diameter distribution measuring instrument 210 for measurement.

The gas sensor 200 in the fire detection device 2 according to the embodiment is used to detect a smoke caused by a forest fire. The smoke caused by the forest fire contains much of thermally-decomposed products of cellulose existing in trees, such as, for example, levoglucosan. Therefore, in the fire detection device 2 according to the embodiment, a MOS gas sensor capable of detecting a change in concentration of thermally-decomposed products such as, for example, levoglucosan existing in the air is used as the gas sensor 200.

The MOS gas sensor is a gas sensor that detects a gaseous chemical substance, by using a change in electric resistance by a reduction reaction or oxidation reaction between the crystal surface of tin dioxide or the like and chemical substance adsorbed on the crystal surface. The MOS gas sensor is divided largely into a sensor for detecting a reducing gas in the air, a sensor for detecting an oxidizing gas in the air, and a sensor for detecting volatile organic compounds (VOCs) in the air.

Figure 4:
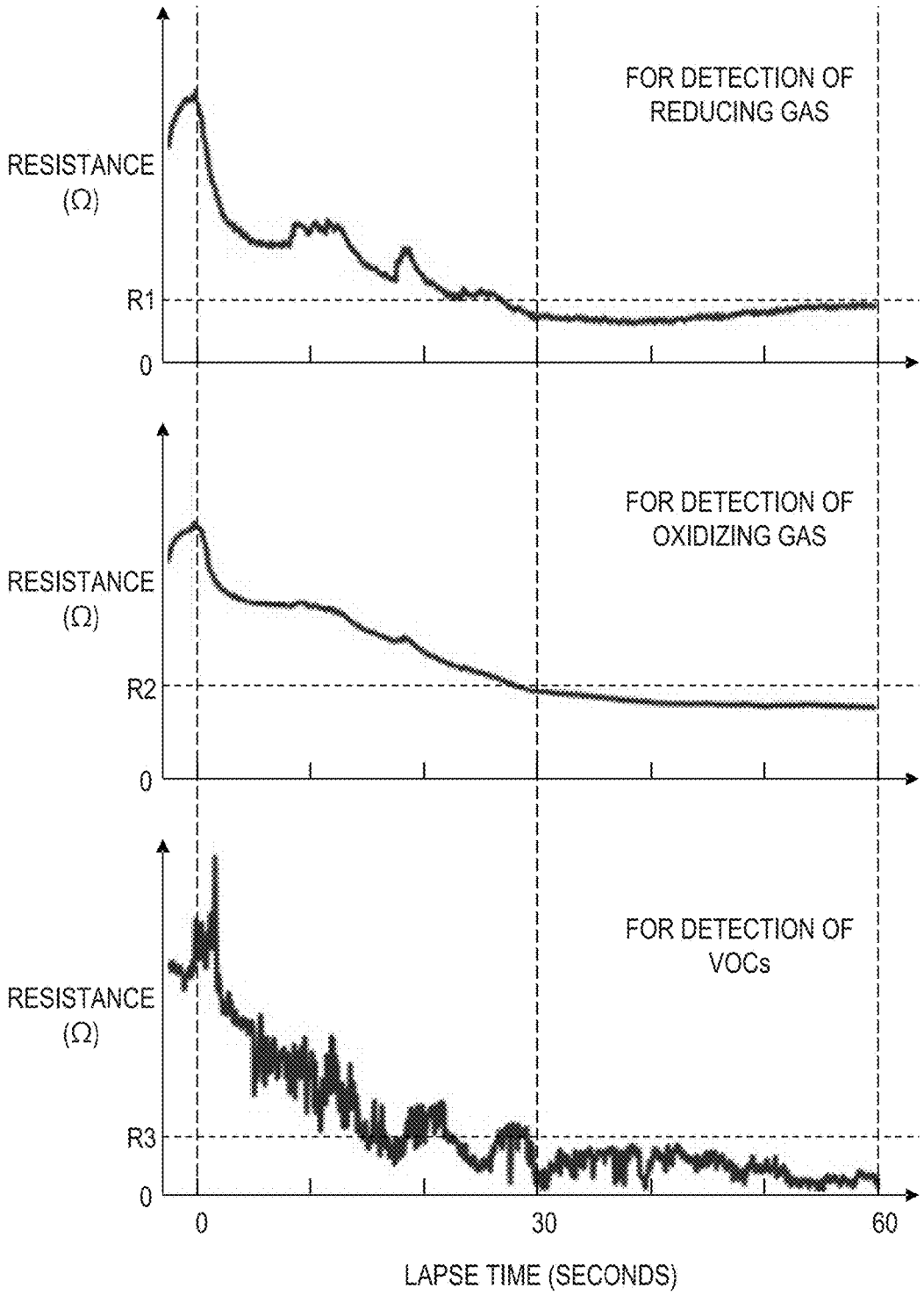
FIG. 4 is a diagram illustrating examples of temporal changes in output values of MOS gas sensors exposed to a smoke.

The present inventors have made detection tests of test gases, which imitates a smoke caused by a forest fire, for these three MOS gas sensors, and have obtained the results illustrated in FIG. 4.

FIG. 4 is a diagram illustrating examples of temporal changes in the output values of MOS gas sensors exposed to a smoke.

The upper graph of FIG. 4 represents a temporal change in electric resistance obtained from an output value of a MOS gas sensor for detecting a reducing gas. The middle graph of FIG. 4 represents a temporal change in electric resistance obtained from an output value of a MOS gas sensor for detecting an oxidizing gas. The lower graph of FIG. 4 represents a temporal change in electric resistance obtained from an output value of a MOS gas sensor for detecting VOCs. In these graphs, a horizontal axis represents lapse time after a smoke (test gas) is injected into a test space.

As is seen from the three graphs illustrated in FIG. 4, in any MOS gas sensors, the resistance value greatly decreases until about 30 seconds elapse after the smoke (test gas) is injected into the test space. Therefore, it is possible to determine whether or not a smoke has occurred, by using a MOS gas sensor as the gas sensor 200 of the embodiment and comparing a resistance value calculated from an output value of the MOS gas sensor with the first determination value. At this time, the MOS gas sensor used as the gas sensor 200 of the embodiment may be any of the reducing gas detecting sensor, the oxidizing gas detecting sensor, and the VOCs detecting sensor.

However, as is seen from the three graphs illustrated in FIG. 4, the three MOS gas sensors have a difference in response speed for a test gas having the same component, in other words, in a way of decrease of a resistance value. In addition, there is a difference in an amount or a composition ratio of a chemical substance contained in a smoke caused by a forest fire, depending on environments (e.g., the presence or absence of artifacts) of a place where the smoke has occurred. Therefore, when a MOS gas sensor is used to detect a smoke, the use of all of the three MOS gas sensors is advantageous to detect a smoke at an early stage with high precision, rather than selecting and using one or two of the three MOS gas sensors.

Figure 5:
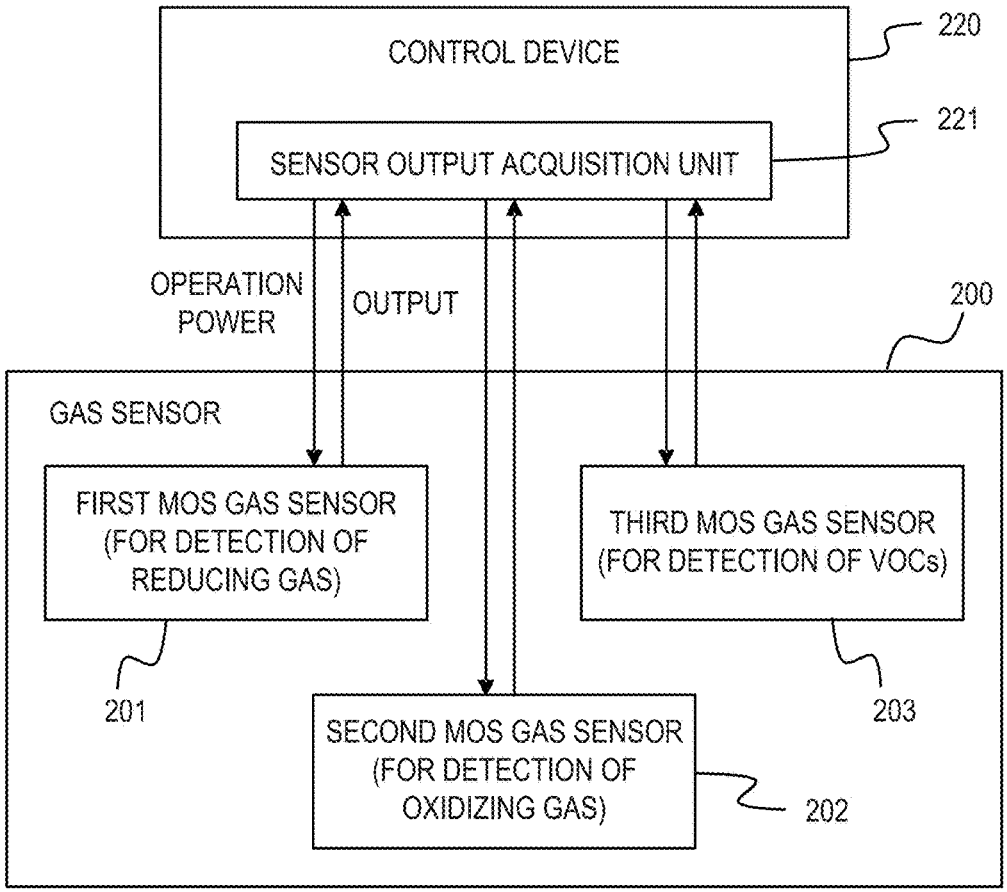
FIG. 5 is a diagram illustrating an exemplary configuration of a gas sensor.

Accordingly, as illustrated in FIG. 5, the embodiment employs a gas sensor 200 which is a combination of a first MOS gas sensor 201 for detecting a reducing gas, a second MOS gas sensor 202 for detecting an oxidizing gas, and a third MOS gas sensor 203 for detecting VOCs. FIG. 5 is a diagram illustrating an exemplary configuration of a gas sensor.

In a case of a combination of different MOS gas sensors for different gases (chemical substances) to be detected, a determination resistance value for each of the MOS gas sensors is set in the first determination value 225A used for determining whether or not a smoke has occurred. For example, in the example illustrated in FIG. 4, in any MOS gas sensors, a resistance value after 30 seconds elapse after a smoke is injected is transitioned to substantially a constant value. In the MOS gas sensor for detecting a reducing gas, a resistance value in a period of lapse time of 30 to 60 seconds is transitioned to a value of R1 or less. In the MOS gas sensor for detecting an oxidizing gas, a resistance value in a period of lapse time of 30 to 60 seconds is transitioned to a value of R2 or less. In the MOS gas sensor for detecting VOCs, a resistance value in a period of lapse time of 30 to 60 seconds is transitioned to a value of R3 or less.

Based on the transition of these resistance values, the first determination value 225A is stored in the storage unit 225, for example, in the form of a table as illustrated in FIG. 6. FIG. 6 is a diagram illustrating an exemplary setting of the first determination value. In the table illustrated in FIG. 6, for the three MOS gas sensors 201 to 203, sensor numbers given to the MOS gas sensors are associated with their respective resistance determination values (thresholds).

When such a first determination value 225A is used, it is determined in S100 and S101 illustrated in FIG. 3 whether or not resistance values calculated from output values of the MOS gas sensors 201 to 203 are equal to or smaller than the determination values R1 to R3, respectively. Then, for example, when a resistance value calculated from an output value of one of the MOS gas sensors 201 to 203 is equal to or smaller than its own determination value, the measurement controller 223A determines that a smoke has occurred. As a result, it is possible to detect an occurrence of a smoke caused by a forest fire at an early stage, irrespective of a type or a composition ratio of a chemical substance contained in the smoke.

Instead of the threshold of the output value (resistance) used for the determination on whether or not a smoke has occurred, a pattern of change in the output value may be set in the first determination value 225A. When the pattern of change in the output value is used as the first determination value, the temporal change in the resistance value for lapse time of 0 to 60 seconds in the graphs illustrated in FIG. 4 is stored in the form of a table in the storage unit 225.

In this case, the control device 220 (the measurement controller 223A) of the fire detection device 2 holds an output value of the gas sensor 200 for 60 seconds or more. In addition, in this case, in S100 illustrated in FIG. 3, the measurement controller 223A calculates the value of correlation between a pattern of change in a resistance value calculated from the previous output value of the gas sensor 200 for 60 seconds and the pattern of change described in the first determination value 225A. Then, when the calculated correlation value is equal to or greater than a threshold, the measurement controller 223A determines that a smoke has occurred.

In this way, by using the plurality of MOS gas sensors for different gases to be detected as the gas sensor 200, the fire detection device 2 according to the embodiment may detect a smoke occurring around an installation position at an early stage.

However, a MOS gas sensor does not have high selectivity for gases to be detected. Therefore, even in a case where the MOS gas sensor is exposed to a different smoke or gas in addition to the smoke caused by a forest fire, an output value (resistance) may be changed in response to this different smoke or gas. This makes it difficult to make a correct determination on an occurrence of a forest fire on the basis of the output value of the MOS gas sensor. Thus, the present inventors have paid attention to the fact that a smoke caused by a forest fire contains gaseous components and particulate components. That is, when the gas sensor 200 (the MOS gas sensors 201 to 203) detects a gaseous component contained in the smoke, the fire detection device 2 according to the embodiment examines a particulate component by means of the particle diameter distribution measuring instrument 210 to determine whether or not a forest fire has occurred.

The particle diameter distribution measuring instrument 210, which is called a particle counter, measures the diameter of particles in the air by using a laser beam or the like, counts the number of particles for every predetermined diameter range (class), and creates a diameter distribution histogram. For example, a certain particle counter creates an accumulative histogram of a diameter distribution for a particle number concentration (e.g., the number of particles contained in air of 1 $m^3$) with diameter range breakpoints of 0.3 μm, 0.5 μm, 0.7 μm, 1.0 μm, 2.0 μm, and 5.0 μm.

Figure 7:
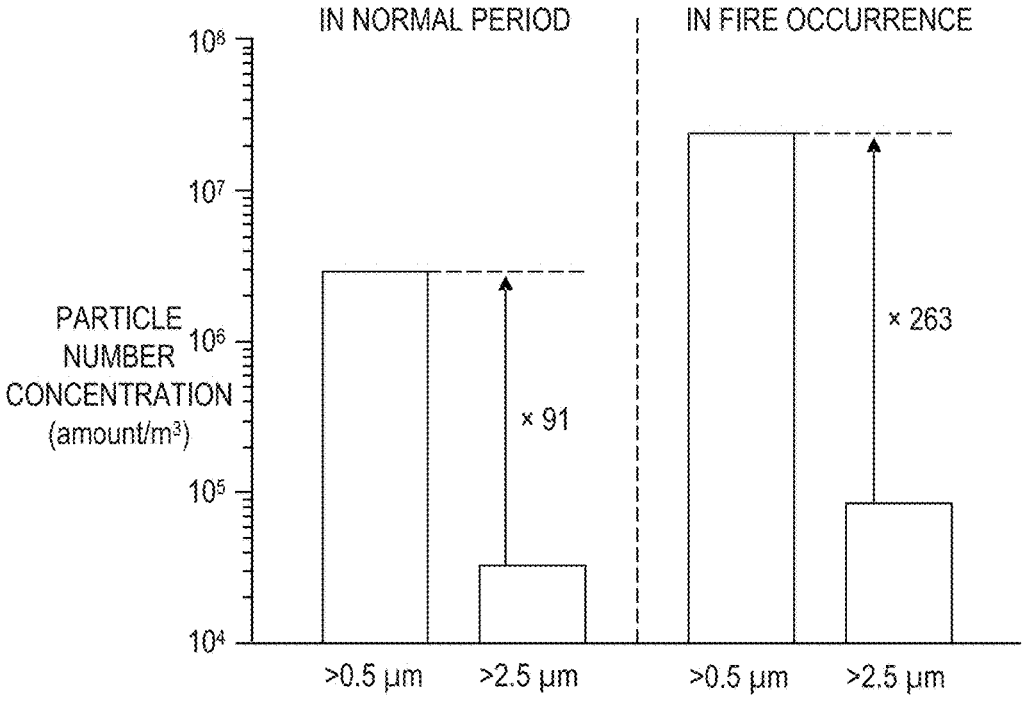
FIG. 7 is a diagram illustrating a difference between a particle concentration in a normal period and a particle concentration in a fire occurrence.

When the particle diameter distribution measuring instrument 210 is used to measure a diameter distribution in the normal period and a diameter distribution in a fire occurrence, for example, a result as illustrated in FIG. 7 is obtained. FIG. 7 is a diagram illustrating a difference between the particle concentration in the normal period and the particle concentration in a fire occurrence. In addition, FIG. 7 illustrates an exemplary result of measurement by the particle diameter distribution measuring instrument 210 with a simplified particle diameter discrimination function.

The result of the measurement in the normal period illustrated in the left side of FIG. 7 relates to a diameter distribution of particles in the air under the environment where no smoke caused by, for example, a forest fire is present. The result of the measurement in a fire occurrence illustrated in the right side of FIG. 7 relates to a diameter distribution of particles in the air under the environment where a test gas imitating a smoke caused by a forest fire spreads. FIG. 7 illustrates the particle number concentrations of each diameter range measured with a diameter range breakpoint of 2.5 μm in each of the normal period and the fire occurrence.

In the measurement result of the diameter distribution during the normal period, the particle number concentration of particles having diameter greater than 2.5 μm became $3.17\times10^4/m^3$, and the particle number concentration of particles having diameter greater than 0.5 μm became $2.90\times10^6/m^3$. In the measurement result of the diameter distribution during the fire occurrence, the particle number concentration of particles having diameter greater than 2.5 μm became $8.81\times10^4/m^3$, and the particle number concentration of particles having diameter greater than 0.5 μm became $2.32\times10^7/m^3$.

The particle number concentration of particles having diameter greater than 0.5 μm in the normal period is about 91 times of the particle number concentration of particles having diameter greater than 2.5 μm in the normal period. The particle number concentration of particles having diameter greater than 0.5 μm in the fire occurrence is about 263 times of the particle number concentration of particles having diameter greater than 2.5 μm in the fire occurrence.

That is, the ratio of the particle number concentration of particles having diameter greater than 0.5 μm to the particles having diameter greater than 2.5 μm in the fire occurrence is about 2.9 times of the normal period.

In this way, the particle number concentration is higher in the fire occurrence than in the normal period by an amount of particle components contained in the smoke.

Therefore, assuming that the particle number concentration in the normal period is the second determination value 225B, when a difference between the second determination value and the particle number concentration obtained from the measurement result of the particle diameter distribution measuring instrument 210 is equal to or greater than a predetermined threshold, the fire detection device 2 according to the embodiment determines that a fire (forest fire) has occurred.

At this time, for example, as illustrated in FIG. 8, in the second determination value 225B, three normal-period values, i.e., a first normal-period value CA, a second normal-period value CB, and a third normal-period value CA/CB, are set, and an update date is described. FIG. 8 is a diagram illustrating an exemplary setting of the second determination value. In FIG. 8, MM, DD, hh, and mm in the update date represent a month, a day, an hour, and a minute, respectively.

The first normal-period value CA indicates the particle number concentration of particles (first class particles) having diameter greater than 0.5 μm in the normal period. The second normal-period value CB indicates the particle number concentration of particles (second class particles) having diameter greater than 2.5 μm in the normal period. The third normal-period value CA/CB is a value obtained by dividing the first normal-period value CA by the second normal value CB. The update date is an update date when the second determination value 225B is updated in S104 illustrated in FIG. 3.

When the second determination value 225B is used, in S112 and S113 illustrated in FIG. 3, for example, the ratio of the particle number concentration of the first class particles to the second class particles in the measurement result is calculated and compared with the third normal-period value CA/CB. When a difference between the particle number concentration ratio in the measurement result and the third normal-period value CA/CB is equal to or greater than a threshold (for example, when the particle number concentration ratio in the measurement result is 1.5 times of the third normal value), the measurement controller 223A determines that a fire has occurred.

When the difference between the particle number concentration ratio in the measurement result and the third normal-period value CA/CB is smaller than the threshold, for example, the measurement controller 223A compares the particle number concentrations of the first and second class particles in the measurement result with the first and second normal values CA and CB, respectively. When the difference between one of the particle number concentrations in the measurement result and a corresponding one of the first and second normal values CA and CB is equal to or greater than a threshold, the measurement controller 223A determines that a fire has occurred.

The above-mentioned difference may be an absolute value of a value obtained by subtracting the particle number concentration in the normal period from the particle number concentration in the fire occurrence or may be a value (quotient) obtained by dividing the particle number concentration in the fire occurrence by the particle number concentration in the normal period. In addition, although in the above descriptions, the diameter range is divided into two classes to perform the determination, without being limited thereto, the diameter range may be divided into three or more classes.

As described above, the fire detection device 2 according to the embodiment may be set to detect presence or absence of a smoke occurrence around an installation position of the gas sensor (MOS gas sensors) either always or periodically at short time intervals of several seconds to several ten seconds. When a smoke occurrence is detected by the gas sensor, the fire detection device 2 measures a diameter distribution in the air around the installation position by means of the particle diameter distribution measuring instrument 210 to determine whether or not a fire (forest fire) has occurred.

That is, based on the gaseous components and particulate components of a smoke caused by a forest fire, the fire detection device 2 determines whether or not a forest fire has occurred. Therefore, the fire detection device 2 according to the embodiment may readily determine whether or not a forest fire has occurred, with a high precision compared to a case where a determination is made based on an image captured by a camera such as, for example, an infrared camera. In addition, since a smoke caused by a forest fire spreads in a wider range in a short time period than the flame (heat), the fire detection device 2 according to the embodiment may detect an occurrence of a forest fire at an early stage.

The fire detection device 2 according to the embodiment supplies an operation power to the particle diameter distribution measuring instrument 210 for the operation thereof only when there is a need to measure a diameter distribution in the air around an installation position by the particle diameter distribution measuring instrument 210. The measurement of the diameter distribution is required only for a case where a smoke occurrence is detected by the gas sensor 200 and a case where diameter distribution data (i.e., the second determination value 225B) in the normal period are updated. The diameter distribution in the air in the normal period may vary every season or time zone (e.g., morning, noon, and night) but will not largely vary in a short time. Therefore, it is sufficient if the update of the second determination value 225B under a situation where no smoke has occurred is performed with a frequency of, for example, once in a few hours. A one-time measurement by the particle diameter distribution measuring instrument 210 is completed in about a few minutes. Accordingly, the fire detection device 2 according to the embodiment may detect (monitor) an occurrence of a forest fire with a high precision while suppressing an increase in power consumption.

In order to investigate a power consumption saving effect achieved by the fire detection device 2 according to the embodiment, the present inventors have estimated a power consumption of the fire detection device 2 prepared under the following conditions. The above-described three MOS gas sensors 201 to 203 were used for the gas sensor 200, and it was assumed that the power consumption of the sensors is about 185 mW in total. It was also assumed that the power consumption of the particle diameter distribution measuring instrument 210 is 2,472 mW. A microcomputer was used for the control device 220, and it was assumed that the power consumption of the microcomputer is about 10 mW.

When the gas sensor 200 and the particle diameter distribution measuring instrument 210 in the fire detection device 2 are always operated to detect whether or not a fire has occurred, the power consumption per day is about 230 kJ. In contrast, as in the embodiment, when only the gas sensor 200 is always operated, and the particle diameter distribution measuring instrument 210 performs a measuring process ten times a day for 120 seconds once, the power consumption per day is about 20 kJ. As a result, the fire detection device 2 according to the embodiment may save power consumption significantly as compared to the case where both of the gas sensor 200 and the particle diameter distribution measuring instrument 210 are always operated.

When detecting (monitoring) whether or not a forest fire has occurred by the forest fire detection system, the fire detection devices 2 are installed, for example, in the mountains, between the mountains, and along the mountains, as illustrated in FIG. 1. Therefore, when power cables are installed to supply an operation power to the fire detection devices 2, the installation cost increases due to the work for installation and the like. Therefore, it is beneficial to use the secondary batteries as power sources of the fire detection devices 2. When the secondary batteries are used as power sources of the fire detection devices 2, it may be contemplated that the fire detection devices 2 is being operated while charging the secondary batteries, for example, by using photovoltaic power generation panels or wind power generators. When the secondary batteries are used as power sources, the secondary batteries may have less capacity by operating devices such as, for example, the fire detection devices 2 according to the embodiment having less power consumption. That is, it is possible to make the fire detection devices 2 to be more compact by using secondary batteries having less capacity. In addition, a small sized photovoltaic power generation panel having a relatively small amount of power generation capacity may be employed.

Figure 9:
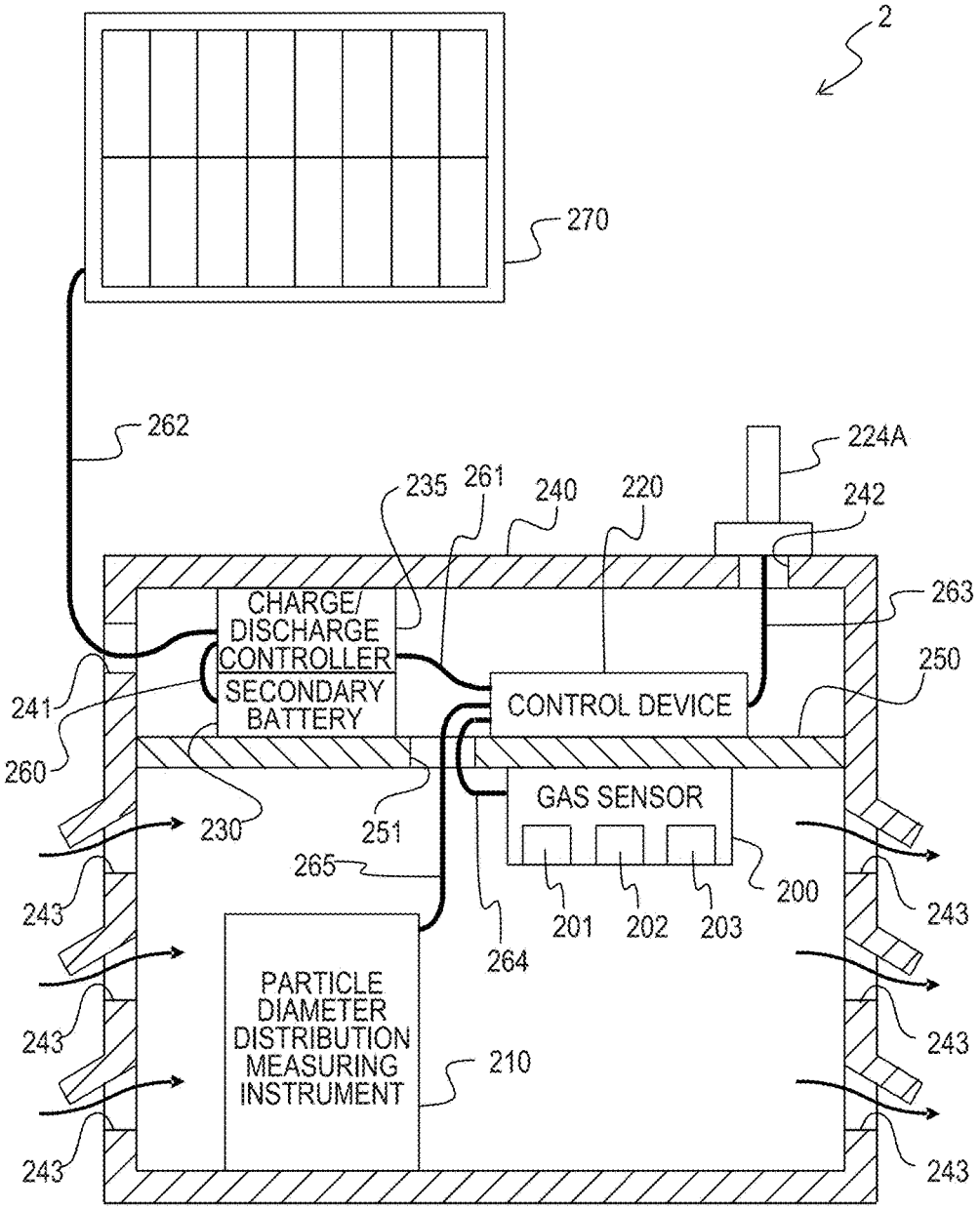
FIG. 9 is a diagram illustrating a physical structure of a fire detection device.

FIG. 9 is a diagram illustrating a physical structure of a fire detection device.

The fire detection device 2 according to the embodiment is installed outdoor. Therefore, for example, the gas sensor 200, the particle diameter distribution measuring instrument 210, the control device 220, and a secondary battery used as a power supply may be accommodated in a box 240 (housing), as illustrated in FIG. 9, in order to prevent a short circuit (malfunction) due to the rainwater or the like. The box 240 is formed of a metal plate or a resin plate, and its internal space is partitioned into two upper and lower spaces by a diaphragm 250.

The upper space of the box 240 accommodates the control device 220, the secondary battery 230 storing an operation power of, for example, the control device 220, and a charge/discharge controller 235 for controlling the charge/discharge of the secondary battery 230. The control device 220 and the secondary battery 230 are attached to the diaphragm 250 by metal fittings. The charge/discharge controller 235 is attached to the box 240 by, for example, metal fittings. The secondary battery 230 and the charge/discharge controller 235 are interconnected by a first feed cable 260. The charge/discharge controller 235 and the control device 220 are interconnected by a second feed cable 261. The secondary battery 230 and the charge/discharge controller 235 may be integrated by, for example, a dedicated holding member.

The lower space of the box 240 accommodates the gas sensor 200 and the particle diameter distribution measuring instrument 210. The gas sensor 200 is attached to the diaphragm 250 by, for example, metal fittings. The gas sensor 200 and the control device 220 are interconnected by a first cable 264 passing through a through hole 251 formed in the diaphragm 250. The particle diameter distribution measuring instrument 210 is attached to the bottom of the box 240 by, for example, metal fittings. The particle diameter distribution measuring instrument 210 and the control device 220 are interconnected by a second cable 265 passing through the through hole 251 formed in the diaphragm 250. The first cable 264 and the second cable 265 may be an integrated form of a feed cable and a data transmission cable or may be separated from each other.

The lateral side upper portion and top surface of the box 240 are respectively formed with a first through hole 241 and a second through hole 242 which communicate with the upper internal space and an external space of the box 240, respectively. The charge/discharge controller 235 is connected to a photovoltaic power generation panel 270 installed in the external space of the box 240 by a third feed cable 262 passing through the first through hole 241. The control device 220 is connected to a radio communication antenna 224A installed in the external space of the box 240 by a transmission cable 263 passing through the second through hole 242. The through holes 241 and 242 formed in the box 240 are blocked by a seal after the cables 262 and 263 are passed therethrough, in order to prevent a failure of the control device 220 due to the rainwater or the like.

Further, a plurality of ventilating holes 243 communicating with the lower internal space and the external space of the box 240 are formed in the lateral side lower portion of the box 240. The lower internal space of the box 240 has substantially the same air environment as the external space by the ventilation through the plurality of ventilating holes 243.

The box 240 accommodating, for example, the control device 220 in the fire detection device 2 illustrated in FIG. 9 is installed at a height of several ten centimeters to several meters from the ground, at which a smoke caused by a forest fire may be easily detected. The photovoltaic power generation panel 270 is installed at a sunny place near the box 240.

As described above, since only the control device 220 and the gas sensor 200 with low power consumption are always operated in the fire detection device 2 according to the embodiment, the secondary battery may have less capacity. Since the less power consumption of the fire detection device 2 allows the less discharge amount of the secondary battery, the secondary battery may be sufficiently charged even with a small amount of power generated by the photovoltaic power generation panel. Therefore, the fire detection device 2 according to the embodiment may be always operated with a small photovoltaic power generation panel 270 with a relatively small amount of power. Accordingly, the fire detection device 2 according to the embodiment may be made more compact by using a small secondary battery 230 and a small photovoltaic power generation panel 270 and may be manufactured at reduced costs.

The fire detection device 2 is not limited to the power generation using the photovoltaic power generation panel 270 illustrated in FIG. 9 but may employ a wind power generator.

The fire detection device 2 illustrated in FIG. 9 is configured to supply an operation power from the charge/discharge controller 235 connected to the secondary battery 230 to the gas sensor 200 and the particle diameter distribution measuring instrument 210 through the control device 220. However, the fire detection device 2 is not limited to such a physical structure but may be configured to directly supply the operation power from the charge/discharge controller 235 to the gas sensor 200 and the particle diameter distribution measuring instrument 210.

The control device 220 of the fire detection device 2 according to the embodiment may be implemented by a computer and a program causing the computer to perform the above-described process.

Figure 10:
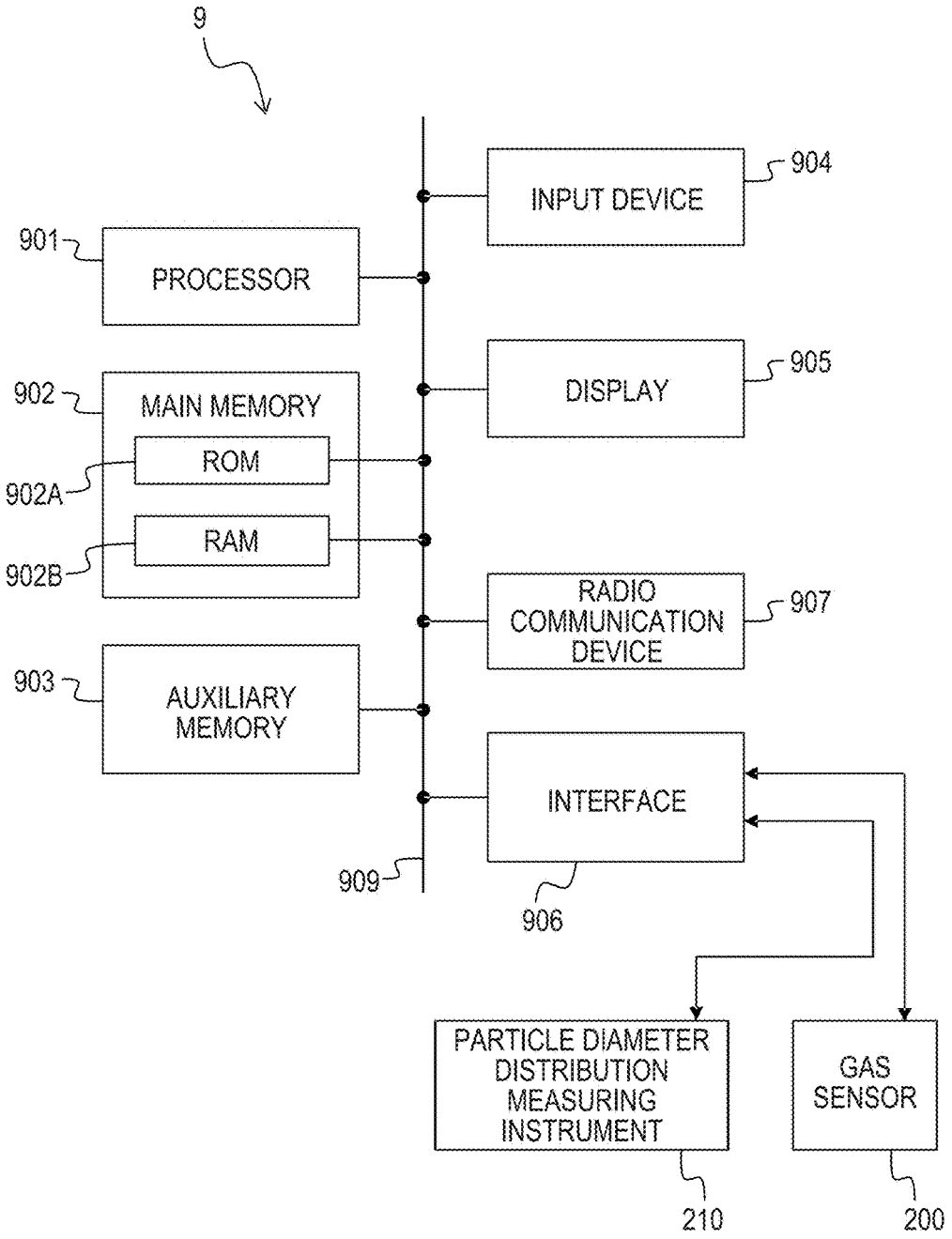
FIG. 10 is a diagram illustrating a hardware configuration of a computer.

FIG. 10 is a diagram illustrating a hardware configuration of a computer.

As illustrated in FIG. 10, a computer 9 includes a processor 901, a main memory 902, an auxiliary memory 903, an input device 904, a display 905, an interface 906, and a radio communication device 907. These elements 901 to 907 in the computer 9 are interconnected by a bus 909 to allow a data exchange therebetween.

The processor 901 is an arithmetic processing device such as, for example, a micro processing unit (MPU). The processor 901 controls the overall operation of the computer 9 by executing a variety of programs including an operating system.

The main memory 902 includes a read-only memory (ROM) 902A and a random access memory (RAM) 902B. The ROM 902A may pre-store, for example, a predetermined basic control program which is read by the processor 901 at the start of the computer 9. The RAM 902B is used as a working memory area as necessary when the processor 901 executes the variety of programs. In the embodiment, the RAM 902B may be used for the memory of, for example, the first determination value 225A and the second determination value 225B, and for a temporary memory of the output value of the gas sensor 200 and measurement data of the particle diameter distribution measuring instrument 210.

The auxiliary memory 903 is a memory having a larger capacity than that of the main memory 902, such as, for example, a solid state drive (SSD). The auxiliary memory 903 stores, for example, a variety of programs executed by the processor 901 along with a variety of data. An example of programs stored in the auxiliary memory 903 may include a program causing the processor 901 to perform the process illustrated in FIG. 3. An example of data stored in the auxiliary memory 903 may include a detection log including, for example, a history of the measurement data of the particle diameter distribution measuring instrument 210 and the output value of the gas sensor 200.

The input device 904 is, for example, a button switch. When the input device 904 is manipulated by an operator of the computer 9, the input device 904 transmits input information corresponding to the manipulation to the processor 901.

The display 905 is, for example, a pilot lamp or a 7-segment display and displays information of, for example, operation states of the computer 9.

The interface 906 is an input/output device which exchanges data with devices other than the computer 9. The interface 906 acts as the sensor output acquisition unit 221 for acquiring the output value of the gas sensor 200 and the distribution data acquisition unit 222 for acquiring the measurement result (distribution data) of the particle diameter distribution measuring instrument 210.

The radio communication device 907 conducts a radio communication with the radio base station 4 and transmits a fire occurrence signal.

The processor 901 of the computer 9 reads a program corresponding to the process of FIG. 3 from the auxiliary memory 903 and monitors (detects) presence or absence of an occurrence of a fire (forest fire) in cooperation with, for example, the main memory 902, the auxiliary memory 903, and the interface 906.

The computer 9 does not need to include all of the elements 901 to 907 illustrated in FIG. 10 but may exclude some elements depending on the use and conditions. For example, when the main memory 902 has a sufficient capacity enough to store programs and data used for a fire detecting process, the auxiliary memory 903 may be excluded.

When initial values such as, for example, the first determination value 225A and the second determination value 225B are pre-stored in the RAM 902B, the input device 904 may be excluded.

In addition, in the computer 9, for example, the processor 901 and the main memory 902 may be of a one-chip configuration.

Figure 11:
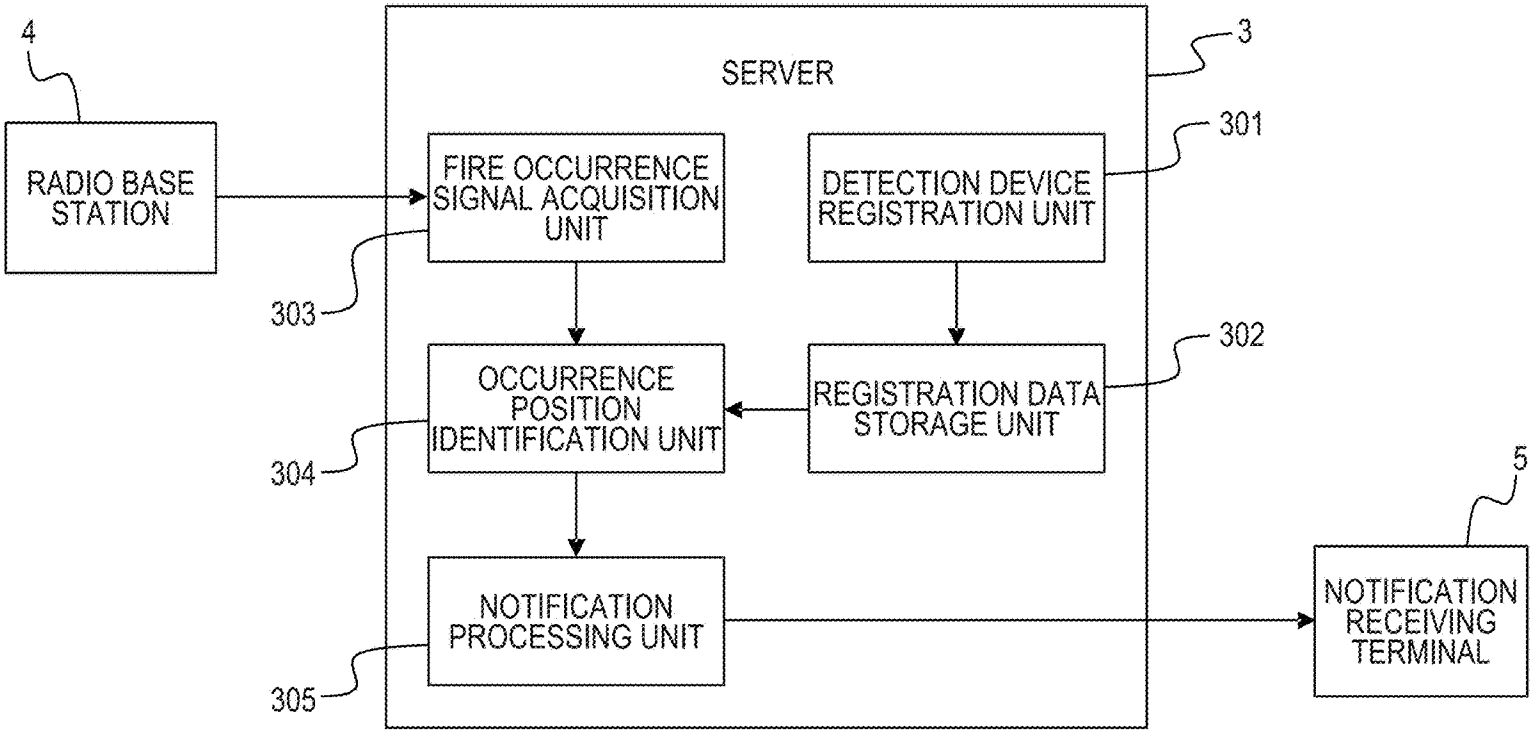
FIG. 11 is a diagram illustrating a functional configuration of a server.

FIG. 11 is a diagram illustrating a functional configuration of a server.

As illustrated in FIG. 11, the server 3 includes a detection device registration unit 301, a registration data storage unit 302, a fire occurrence signal acquisition unit 303, an occurrence position identification unit 304, and a notification processing unit 305.

The detection device registration unit 301 performs a process of registering identification numbers and installation positions of detection devices installed in an area to be monitored, that is, where a forest fire is to be detected. For example, when an operator manipulates an input device such as, for example, a keyboard connected to the server 3 to input information indicating the identification numbers and installation positions, the detection device registration unit 301 registers (stores) the information indicating the identification numbers and the installation positions in registration data stored in the registration data storage unit 302.

The fire occurrence signal acquisition unit 303 acquires a fire occurrence signal transmitted by the fire detection device 2.

The occurrence position identification unit 304 identifies a fire occurrence position (area) on the basis of the identification number of the fire detection device 2 included in the fire occurrence signal and the registration data of the registration data storage unit 302.

The notification processing unit 305 generates a notification signal notifying an occurrence of a fire (forest fire) on the basis of the fire occurrence position identified by the occurrence position identification unit 304 and transmits the notification signal to, for example, the notification receiving terminal 5 installed in, for example, a fire station.

FIG. 12 is a diagram illustrating an example of the registration data.

As illustrated in FIG. 12, registration data 310 stored in the registration data storage unit 302 of the server 3 includes information indicating identification numbers and installation positions of fire detection devices.

The identification numbers are numerals identifying a plurality of fire detection devices 2 managed by one forest fire detection system (server 3). When M fire detection devices 2 are used to detect (monitor) a fire, the M fire detection devices 2 are assigned with identification numbers from 1 to M, respectively.

An installation position of each fire detection device 2 is represented by, for example, the latitude and longitude as illustrated in FIG. 12. The installation position information (latitude and longitude) is acquired from, for example, a map at a stage of determining the installation position of the fire detection device 2. The fire detection device 2 is installed by performing only the rough alignment by referring to the map or performing the alignment by using a global positioning system (GPS).

Figure 13:
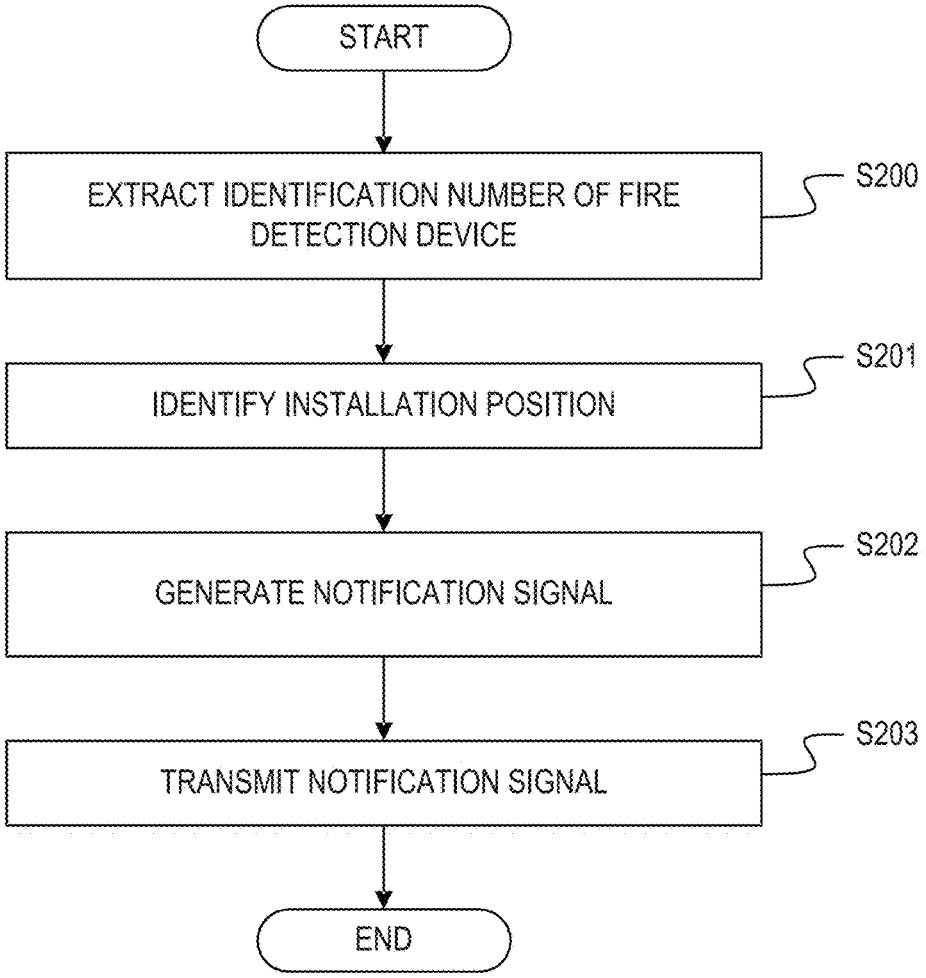
FIG. 13 is a flowchart illustrating a first example of a notification process performed by a server.

FIG. 13 is a flowchart illustrating a first example of a notification process performed by the server.

The server 3 is at all times communicably connected with the radio base station 4 via a wired or wireless communication. Upon receiving a fire occurrence signal from a fire detection device 2 via the radio base station 4, the server 3 performs the process illustrated in FIG. 13 to notify the notification receiving terminal 5 installed in a fire station for example, of an occurrence of a forest fire. At this time, the server 3 receives (acquires) the fire occurrence signal by the fire occurrence signal acquisition unit 303. The fire occurrence signal acquisition unit 303 sends the acquired fire occurrence signal to the occurrence position identification unit 304.

Then, as illustrated in FIG. 13, the occurrence position identification unit 304 first extracts an identification number of the fire detection device 2 which has transmitted the fire occurrence signal (S200).

Next, the occurrence position identification unit 304 searches the registration data 310 of the registration data storage unit 302 using the extracted identification number as key information and identifies an installation position of the fire detection device 2 which has transmitted the fire occurrence signal (S201). Upon identifying the installation position of the fire detection device 2 which has transmitted the fire occurrence signal, the occurrence position identification unit 304 sends information of the fire occurrence signal and the identified installation position to the notification processing unit 305.

Upon receiving the information of the fire occurrence signal and the identified installation position, the notification processing unit 305 generates a notification signal notifying that a forest fire has occurred near the installation position identified by the occurrence position identification unit 304 (S202). The notification signal generated by the notification processing unit 305 in S202 includes the time at which the fire occurrence signal is transmitted, and the installation position of the fire detection device 2 which has transmitted the fire occurrence signal.

Thereafter, the notification processing unit 305 notifies the generated notification signal to the notification receiving terminal 5 installed in, for example, the fire station (S203). Upon receiving the notification signal from the server 3, the notification receiving terminal 5 notifies firemen of when and where a forest fire has occurred, through a speaker or a display.

In this way, the server 3 in the forest fire detection system according to the embodiment identifies and notifies of a fire occurrence position on the basis of the fire occurrence signal from the fire detection device 2 which has detected the forest fire occurrence.

In the forest fire detection system according to the embodiment, as illustrated in FIG. 1, there may be a case where a plurality of fire detection devices 2 installed near the fire occurrence position 6 detect an occurrence of a fire substantially simultaneously and transmit fire occurrence signals. Therefore, a notification process performed by the server 3 is not limited to the above-described process. For example, as illustrated in the process of FIG. 14, the server 3 may generate a notification signal by estimating a fire occurrence position on the basis of installation positions of the plurality of fire detection devices 2.

Figure 14:
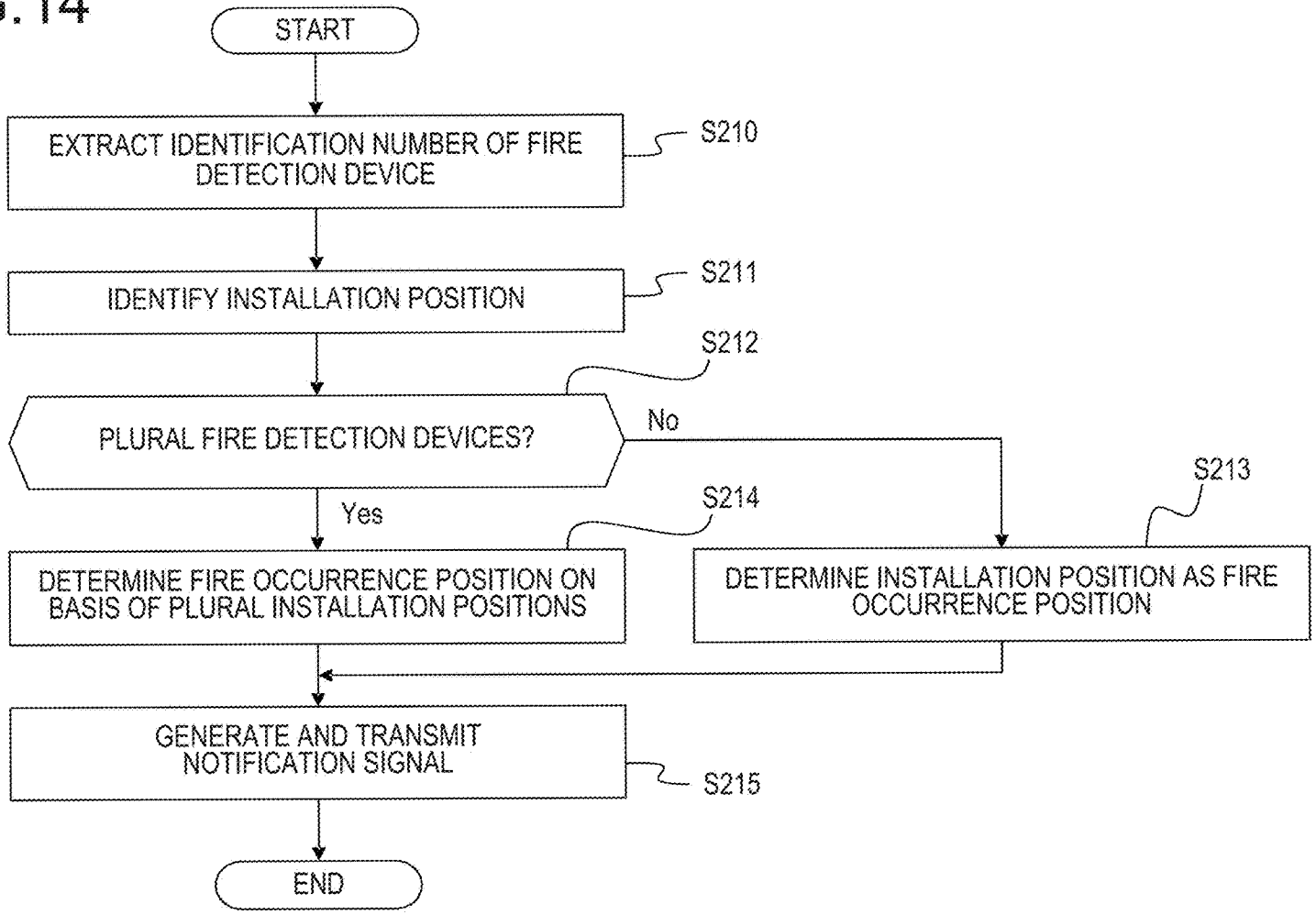
FIG. 14 is a flowchart illustrating a second example of a notification process performed by a server.

FIG. 14 is a flowchart illustrating a second example of the notification process performed by the server.

In the second example of the notification process, upon receiving (acquiring) a fire occurrence signal by the fire occurrence signal acquisition unit 303 and sending the acquired fire occurrence signal to the occurrence position identification unit 304, the server 3 performs the notification process illustrated in FIG. 14.

In this notification process, as illustrated in FIG. 14, the occurrence position identification unit 304 of the server 3 first extracts an identification number of the fire detection device 2 which has transmitted the fire occurrence signal (S210).

Next, the occurrence position identification unit 304 searches the registration data 310 of the registration data storage unit 302 using the extracted identification number as key information and identifies installation position of the fire detection device 2 which has transmitted the fire occurrence signal (S211).

Next, the occurrence position identification unit 304 checks whether or not the fire occurrence signals have been received from a plurality of fire detection devices 2 within a predetermined time (e.g., one minute) (S212). In S212, the occurrence position identification unit 304 waits until the predetermined time elapses after identifying the installation position in S211, and checks whether or not other fire occurrence signals are received in the meantime. When other fire occurrence signals are not received while waiting (No in S212), the occurrence position identification unit 304 determines the previously identified installation position of the fire detection device 2 as a fire occurrence position (S213). When other fire occurrence signals are received while waiting (Yes in S212), the occurrence position identification unit 304 determines a fire occurrence position on the basis of the installation positions of the plurality of fire detection devices 2, that is, the fire detection device 2 which has been identified the installation position thereof in S211 and other fire detection devices 2 which have transmitted the other fire occurrence signals (S214). In S214, for example, the occurrence position identification unit 304 determines the middle (center) of the installation positions of the plurality of fire detection devices 2 as a fire occurrence position. Upon determining the fire occurrence position in S213 or S214, the occurrence position identification unit 304 sends the determined fire occurrence position to the notification processing unit 305.

Upon receiving information on the fire occurrence position from the occurrence position identification unit 304, the notification processing unit 305 generates a notification signal and transmits the notification signal to the notification receiving terminal 5 (S215).

In this way, when fire occurrence signals are substantially simultaneously received from a plurality of fire detection devices 2, by determining and notifying a fire occurrence position on the basis of the fire occurrence signals, it is possible to allow notified firemen to rush into the fire occurrence site. As a result, it is possible to minimize the damages caused by the forest fire.

When a fire occurrence position is determined based on the installation positions of the plurality of fire detection devices 2 in S214, without being limited to the middle (center) of the installation positions as described above, the occurrence position identification unit 304 may determine the fire occurrence position using, for example, a predetermined function. For example, the occurrence position identification unit 304 may estimate a fire occurrence position by analyzing smoke spreading situations on the basis of the installation positions of the plurality of fire detection devices 2 and transmission time of the fire occurrence signals.

In the forest fire detection system 1 according to the embodiment, the server may use the installation position information as an identifier of each fire detection device 2, instead of identifying the installation position of each fire detection device 2 by referring to the registration data 310 in the server 3. That is, the installation position information (e.g., latitude and longitude) may be stored in the storage unit 225 at the time of installation of the fire detection devices 2, and a fire occurrence signal containing an installation position instead of an identification number may be generated and transmitted to the server 3.

Although in the embodiment, a notification signal is transmitted from the server 3 to the notification receiving terminal 5 of, for example, the fire station, without being limited thereto, the server 3 may be installed in, for example, the fire station and may directly notify the firemen of a fire occurrence.

The server 3 according to the embodiment may be implemented by a computer and a program causing the computer to execute the above-described process. The computer acting as the server 3 may be, for example, of a hardware configuration as illustrated in FIG. 10. For an input device in the computer acting as the server 3, devices such as, for example, a keyboard or a mouse may be used. For a display in the computer acting as the server 3, devices capable of displaying a variety of text data and moving picture data, such as, for example, a liquid crystal display may be used.

The computer operated as the server 3 may include, for example, a recording medium drive, in addition to the elements illustrated in FIG. 10. The recording medium drive performs reading of programs and data stored in a transportable storage medium (not illustrated) and writing of data and so on stored in the auxiliary memory 903 into the transportable storage medium. Examples of the transportable storage medium may include a flash memory with a connecter of the universal serial bus (USB) standard, and optical discs such as, for example, a compact disc (CD), a digital versatile disc (DVD), and Blu-ray® disc.

Although a forest fire detection system has been described in the above embodiment, the fire detection system of the present disclosure is not limited thereto but may be applied to detecting (monitoring) of a fire in an extended area such as, for example, woods and large-scaled warehouses.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to an illustrating of the superiority and inferiority of the invention. Although the embodiments of the present invention have been described in detail, it should be understood that the various changes, substitutions, and alterations could be made hereto without departing from the spirit and scope of the invention.

What is claimed is:

1. A fire detection device, comprising:

a gas sensor configured to detect a gaseous substance in a measurement space, and output a first result of the detection;

a measurement instrument configured to measure a diameter of each particle existing in the measurement space, and count a number of particles for each of diameter ranges to generate distribution data; and a control device including:

a processor configured to determine, on basis of the first result acquired from the gas sensor, whether smoke exists in the measurement space, start the measurement instrument upon determining that the smoke exists in the measurement space, and determine, on basis of a first instance of the distribution data acquired from the measurement instrument, whether a fire has occurred.

2. The fire detection device according to claim 1, wherein the gas sensor includes a metal-oxide semiconductor claim (MOS) gas sensor.

3. The fire detection device according to claim 2, wherein the processor is configured to determine whether the smoke exists in the measurement space on basis of a similarity between a first pattern of temporal change in a resistance value of the MOS gas sensor and a predetermined change pattern, the first pattern being calculated on basis of the first result acquired from the MOS gas sensor, the first result including the resistance value.

4. The fire detection device according to claim 2, wherein the gas sensor includes a plurality of MOS gas sensors to detect different gaseous substances.

5. The fire detection device according to claim 1, wherein the processor is configured to start the measurement instrument, to acquire a second instance of the distribution data from the measurement instrument, upon determining that the smoke does not exist in the measurement space when a predetermined condition of timing is satisfied, update a determination value on basis of the second instance of the distribution data acquired from the measurement instrument, and determine, on basis of a difference between the determination value and the first instance of the distribution data, whether a fire has occurred.

6. The fire detection device according to claim 1, wherein the diameter ranges are obtained by dividing diameters of particles into two or more classes, and the measurement instrument counts the number of particles for each of the classes.

7. The fire detection device according to claim 1, wherein the processor is configured to stop the measurement instrument upon acquiring the first instance of the distribution data from the measurement instrument.

8. The fire detection device according to claim 1, wherein the processor is configured to supply an operation power to the measurement instrument to start the measurement instrument, and stop the supply of the operation power to the measurement instrument upon acquiring the first instance of the distribution data from the measurement instrument.

9. The fire detection device according to claim 1, further comprising:

a secondary battery used as a power supply of the gas sensor, the measurement instrument, and the control device;

a photovoltaic power generation panel configured to charge the secondary battery; and a charge/discharge controller configured to control charge/discharge of the secondary battery.

10. The fire detection device according to claim 1, wherein the processor is configured to generate, upon determining that a fire has occurred, a fire occurrence signal containing identification information for identifying the fire detection device, and transmit the generated fire occurrence signal to a predetermined server.

11. A method of detecting a fire, the method comprising:

acquiring, by a computer, a first result of detecting a gaseous substance in a measurement space, the first result being output from a gas sensor;

determining, on basis of the first result, whether smoke exists in the measurement space;

starting a measurement instrument upon determining that the smoke exists in the measurement space, the measurement instrument being configured to measure a diameter of each particle existing in the measurement space and to count a number of particles for each of diameter ranges to generate distribution data; and determining, on basis of a first instance of the distribution data acquired from the measurement instrument, whether a fire has occurred.

12. The method according to claim 11, further comprising:

generating, upon determining that a fire has occurred, a fire occurrence signal containing an identification information for identifying the computer; and transmitting the generated fire occurrence signal to a predetermined server.

13. The method according to claim 11, further comprising:

stopping the measurement instrument upon acquiring the first instance of the distribution data from the measurement instrument.

14. The method according to claim 11, further comprising:

starting the measurement instrument, to acquire a second instance of the distribution data from the measurement instrument, upon determining that the smoke does not exist in the measurement space when a predetermined condition of timing is satisfied;

updating a determination value on basis of the second instant of the distribution data acquired from the measurement instrument; and determining, on basis of a difference between the determination value and the first instance of the distribution data, whether a fire has occurred.

15. A non-transitory computer-readable recording medium having stored therein a program that causes a computer to execute a process, the process comprising:

acquiring a first result of detecting a gaseous substance in a measurement space, the first result being output from a gas sensor;

determining, on basis of the first result, whether smoke exists in the measurement space;

starting a measurement instrument upon determining that the smoke exists in the measurement space, the measurement instrument being configured to measure a diameter of each particle existing in the measurement space and to count a number of particles for each of diameter ranges to generate distribution data; and determining, on basis of a first instance of the distribution data acquired from the measurement instrument, whether a fire has occurred.

* * * * *